United States Patent [19]

Bachmann et al.

[11] 4,388,057

[45] Jun. 14, 1983

[54] DEVICE FOR THE CONTINUOUS APPLICATION OF LIQUID FINISH TO A SPINNERET

[75] Inventors: Adolf Bachmann, Heimbuchenthal; Joachim Boehler, Grosswallstadt; Heinz Linhart, Erlenbach, all of Fed. Rep. of Germany

[73] Assignee: Akzona, Incorporated, Asheville, N.C.

[21] Appl. No.: 279,846

[22] Filed: Jul. 2, 1981

Related U.S. Application Data

[62] Division of Ser. No. 144,278, Apr. 28, 1980, Pat. No. 4,301,101.

[30] Foreign Application Priority Data

May 14, 1979 [DE] Fed. Rep. of Germany ..... 2919331

[51] Int. Cl.[3] ..... A01J 21/00

[52] U.S. Cl. ..... 425/97; 425/225; 425/227

[58] Field of Search ..... 425/97; 264/169

[56] References Cited

U.S. PATENT DOCUMENTS 3,056,163 10/1962 Deis ..... 425/97
3,219,733 11/1965 Harris et al. ..... 425/97
3,304,577 2/1967 Mott ..... 425/97
4,124,666 11/1978 Wilhelm et al. ..... 264/169
4,203,939 5/1980 Drachenberg et al. ..... 264/176 F

FOREIGN PATENT DOCUMENTS 44-2492 2/1969 Japan ..... 264/169

*Primary Examiner*—Jay H. Woo
*Attorney, Agent, or Firm*—Antonelli, Terry & Wands

[57] ABSTRACT

A device for the continuous application of spin finishes to a spinneret as well as a process of said application are described. The device has a flat distribution body which can be attached and detached to the exit face of a spinneret. Holes are provided in the body corresponding to the spinneret orifices for melt spinning of filaments. Also the device includes a fastening member for pressing the distribution body on to the exit face of the spinneret. This member has a feeding orifice for the spin finish.

The device may also include seals arranged above and below the distribution body. The distribution body may be sieve-like or consist of a perforated foil or of a foil having channel-like recesses linked with each other and an inlet orifice for the spin finish. The foil may have raised portions that serve as baffles and that are arranged in a pattern between the individual recesses.

14 Claims, 3 Drawing Figures

FIG. 1.
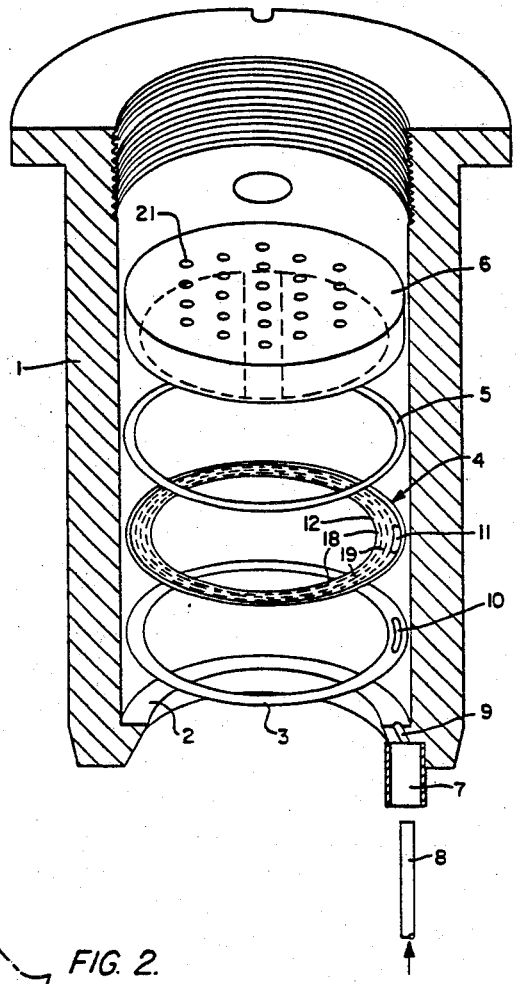
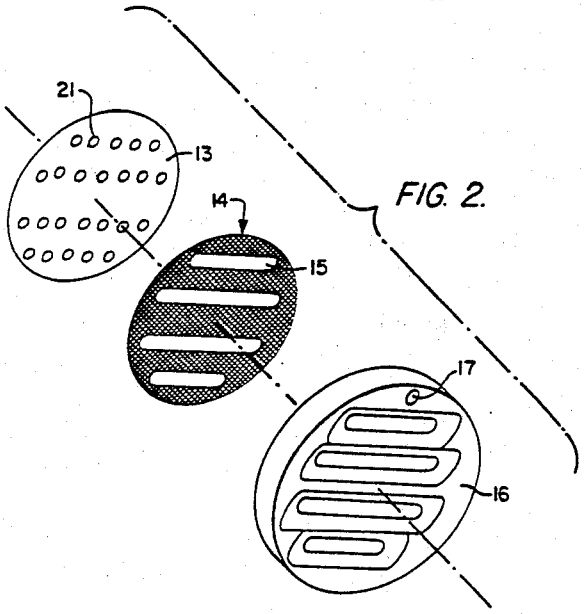
FIG. 2.

DEVICE FOR THE CONTINUOUS APPLICATION OF LIQUID FINISH TO A SPINNERET

This is a division of application Ser. No. 144,278, filed Apr. 28, 1980, now U.S. Pat. No. 4,301,101.

The invention relates to a device and process for the continuous application of finish, especially silicone oil, on the exit face of spinnerets and to the utilization of spinnerets equipped with such devices for production of fibers or synthetic polymers by the melt-spinning process.

In melt-spinning suitable thermoplastic polymers, e.g. polyamide or polyester, the melted polymeric spinning material is extruded through spinnerets which are generally provided with a plurality of exit openings referred to also as spinning orifices or spinning bores.

Since in most cases the spinning material is extruded at high pressure through the spinning orifices, the filaments emerging from the spinneret have a tendency to form a so-called balloon below the exit surface of the spinneret. Balloon formation refers to the balloon-like expansion of the filament immediately below the spinneret; there may be some creeping of the filament thereby so that the axis of the filament shifts away from the axis of the spinneret orifice. This may entail a change in the velocity of individual filaments and lead to premature contact between adjacent filaments. Also this may result in mutual sticking of the filaments producing unevennesses in the yarn.

It is also possible that creep will cause a droplet to form at the spinning orifice due to breakage of the filament. This droplet may quickly encroach on other spinneret orifices, and spinning has to be interrupted to clean the spinneret. This is accomplished in most cases by mechanical means by stripping or scraping away the polymer melt or other deposits with a blade-shaped device. This procedure is frequently referred to as scraping.

To overcome the above-mentioned problems it is known to apply a finish, e.g. a solid coating of a specific material to the exit face of the spinneret, i.e. the face of the spinneret from which the polymer emerges in the form of a filament.

However, in most cases the exit face is coated with a liquid substance, especially silicone oil.

In practice, the silicone oil or any other suitable oil is preferably applied discontinuously, i.e. a suitable finish is applied, e.g. by means of a brush or spraying nozzle, on the exit face of the spinneret. However, there have been many attempts to apply the finish continuously.

In, for example, German patent disclosure No. 1 660 497, spinneret disks are described with oil reservoirs that surround the exit orifices and that also contain a layer of porous material. The manufacture of these spinnerets is relatively complex and cleaning thereof is difficult; moreover, these spinnerets wear fairly rapidly and there is a risk when overhauling them, i.e. during grinding, of ruining them, that is making them unfit for use.

German patent disclosure No. 2 713 601 describes a device and process wherein finish oil is applied at the periphery of the spinneret between the rim and the spinning orifices nearest the rim. The drawback of this process is the cost involved in equipping spinning machines having many spinning points; moreover, with spinnerets of large dimensions it is difficult always to obtain a uniform distribution of the finish film.

U.S. Pat. No. 3,304,577 describes a spinneret whose exit face is provided with a firmly bonded porous metal coating. This coating can be continuously supplied with finish via a line running through the spinneret disk or plate.

The drawback is the difficulty of cleaning these spinnerets for on the one hand the metal coating can be damaged thereby and on the other hand the metal coating may affect the very fragile exit orifices of the spinnerets.

Although a number of processes for the continuous finishing of exit orifices of spinnerets are available, there is still a need for improved, more efficient devices and processes.

One object of this invention is to provide a device allowing continuous application of a uniform finish film on the exit face of a spinneret which device is easily manufactured, easy to maintain, and which, without extensive design modification, can be mounted on conventional spinnerets.

Furthermore, another object of this invention is to provide for a device whereby conventional spinning plates or other spinnerets, e.g. spinneret caps, need not be altered and whereby the oil supply does not have to pass through the spinning plate or spinneret.

These objectives are met with a spinneret equipped with a device for continuous application of finish on the exit face of the spinneret, the device comprising a removable and reinstallable substantially flat distribution element provided with at least one opening corresponding to the pattern of spinneret orifices, and means for directing the flow of liquid finish around said at least one opening and over at least a portion of the exit face of the spinneret, and a fastening means for force-fitting the distribution element onto the exit face of the spinneret, the fastening means including a supply opening for the entry of the liquid finish and under certain conditions seals/gaskets above and below the distribution element.

The distribution element may be in the form of a screen. Also, the distribution element may be in the form of a perforated foil or sheet.

In an especially advantageous embodiment of the invention, the distribution element consists of a foil having channel-like, mutually connected recesses and an inlet opening for the liquid finish. A pattern of raised portions may be provided between individual channels as well as raised portions acting as baffles. In all embodiments, the distribution element is closely subjacent to the exit face of the spinning plate or spinneret.

The distribution element may assume an annular shape. Disk-like distribution elements are also eminently suitable; the disk-like distribution elements are preferably designed with slit-like openings corresponding to the pattern position of the extrusion orifices in the spinning plate of the spinneret assembly.

It is advantageous to have a surface-active distribution element, i.e. one that is wettable by the finish.

The support surface of a spinneret housing may also serve as fastening means. Supporting plates provided with slits corresponding to the spinning orifice pattern are also suitable fastening means.

The process used according to the invention for the continuous application of the finish on the exit face of the spinneret is characterized in that oil is continuously metered via a feed opening in a fastening element to a flat removable and reinstallable distribution element with openings corresponding to the spinning orifices, the distribution element being force-fitted by means of the fastening element to the exit face of the spinneret.

The finish can be supplied by means of a metering pump. However, the finish can also be fed by hydrostatic pressure.

The spinneret with the device to apply finish is used according to the invention in the production of filaments of synthetic polymers by the melt-spinning process.

The distribution element of the invention is best composed of an anti-corrosive material which is resistant to attack under the conditions prevailing at the spinneret during melt-spinning. It must furthermore be resistant to the finish being used. Care must also be taken that use is preferably made of a material resistant to the cleansers normally used to clean spinning plates.

Use is preferably made of anti-corrosive metal alloys, specifically chromium or chromium-nickel steel.

The feed opening or inlet for the finish is generally provided off center and preferably into the edge of the distribution element or fastening means.

The invention is hereinafter described in greater detail with reference to the accompanying drawings wherein:

FIG. 1 is a schematic exploded view of one embodiment of the invention wherein a support surface of a spinneret housing is used as fastening means for an annular-shaped distribution element;

FIG. 2 is a schematic exploded view of yet another embodiment of the invention wherein the distribution element is a screen that is held to the face of the spinning plate by a support plate.

Figure 3:
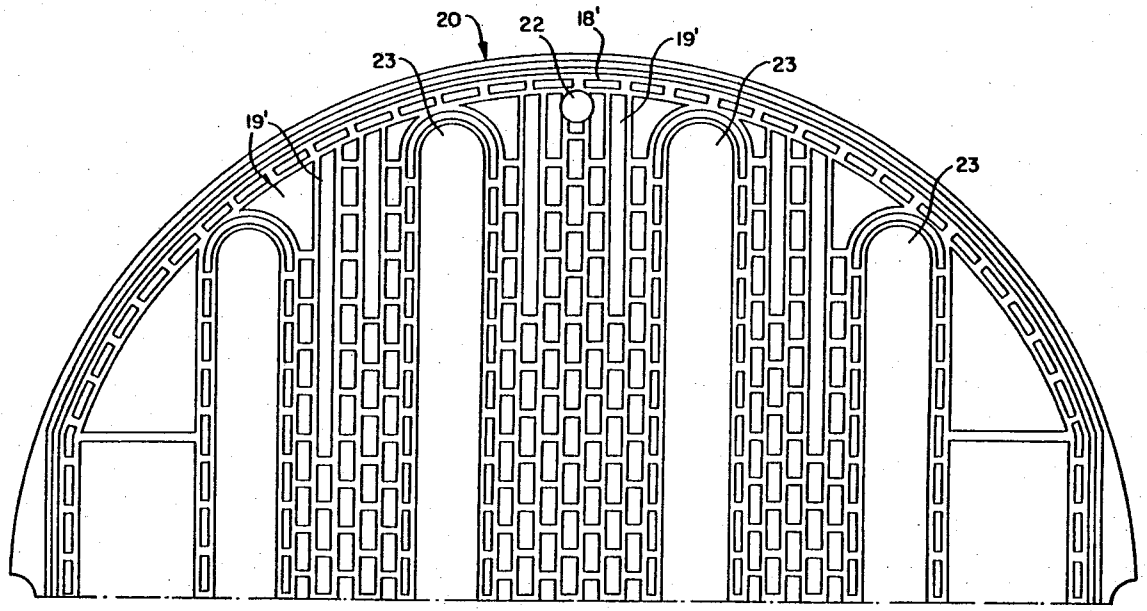
FIG. 3 is an enlarged partial plan view of another embodiment of the distribution element.

In FIG. 1, spinneret housing is provided at its lower end with an annular support surface 2. On this support surface are placed, under certain conditions, a gasket ring 3 with an opening 10 to allow a liquid finish to pass upwardly, a distribution element 4 with an opening 11 to admit the finish and with an annular portion 12 to distribute the finish, under certain conditions, a second gasket ring 5 and a spinning plate 6 provided with a number of spinning orifices 21.

As the spinning orifices in the spinning plate are relatively close, the distribution element has an annular shape so that the filaments can emerge unimpeded through the circular central opening provided therein.

The spinneret housing is mounted on a corresponding spinning head. The pressure of the polymeric melt for forming filaments forces the spinning plates, gasket rings and distributor ring firmly onto the support surface 2.

The finish reaches, via line 8 and a feed nipple 7, a passage or opening 9 within the support surface 2 so that finish may flow through openings 10 and 11 to the distribution element and there be distributed over the annular surface of the portion 12 and whence wet the outer exit face of the spinning plate and of the spinneret.

It is, of course, possible to connect the finish feed line after installation of the spinneret in a different manner to the support surface or to the fastening means, e.g. with pressure-fitted connections such as plug connectors or form-fitting connections such as bayonnet connections or screw connections.

The distribution element illustrated in FIG. 1 consists of a metal foil or thin sheet having an annular configuration and being provided with interconnectd channel-like recesses 18 separated by raised portions 19 on the side facing the spinning plate.

FIG. 2 shows another embodiment of the invention. Here, reference numeral 13 represents a spinning plate with associated spinning orifices 21. The distribution element 14 is a screen with slit-shaped openings 15 suitable matching the rows of spinning orifices 21 in the spinning plate. The distribution element and the spinning plate are fastened by means of a support plate 16 provided with an inlet 17 for the finish and slits whose locations correspond to those of the openings in the distribution element. The support plate 16 is mounted within a spinneret housing together with the spinning plate and the distribution element. The support plate may be supported within a housing by lug projections or an annular rim that extends inwardly from the lower end of the housing in a manner similar to support surface 2 shown in FIG. 1. Also the support plate may be clamped or otherwise secured to the spinning plate with the distribution element held between the plates.

FIG. 3 is an especially advantageous embodiment of the invention in which the distribution element 20 is formed by a metal foil, provided with mutually connected channel-like recesses 18′ and between the recesses with a pattern of raised portions 19′. These raised portions are designed to serve as baffles and are intended to provide better and more uniform distribution of the finish over the entire distribution element. The metered finish reaches the channels in the distribution foil via opening 22.

The foil has slit-like recesses 23 through which the spun filaments travel unimpeded into the spinning chimney.

Annular distribution elements can be designed in a similar fashion.

The production of screen-like distribution elements can be accomplished conventionally with metal wire. The openings or slits can be punched, cut or provisions therefor may be made beforehand during the manufacture of the screen elements.

Distribution elements of perforated foil may likewise be produced in a conventional manner, e.g. by punching holes in appropriate foils.

The channel-like recesses in the distribution elements as well as the pattern of raised portions and of baffles can be obtained by conventional metal working methods. The structure can be obtained mechanically; it is also possible by chemical means, e.g. etching using appropriate patterns, or by electrolytic or other processes to provide the structure in the metal foil.

The thickness of the foil may vary within a wide range; suitable thicknesses are about 0.1 to 2 mm. The recesses or channels provided in the distribution elements involve generally from $\frac{1}{4}$ to $\frac{3}{4}$ of the thickness of the foil and, therefore, have a depth between 0.05 to 1.5 mm. Foils of a thickness of 0.15 to 0.25 mm with a channel depth of about 0.1 mm are particularly suitable.

In applying finish to the spinneret according to the invention the finish reaches the distribution element via an opening in a fastening means. The amount of finish supplied is matched to the consumption. The finish can be supplied continuously in an amount matching the consumption to the distribution element by means of a metering pump. In many cases it has been found expedient to feed the finish oil by means of the hydraulic pressure in the feed line. To this end the reservoir holding the finish to be metered need only be located at a suitable height with respect to the distribution element. This insures a continuous supply of the finish oil.

In many cases all that is needed is to impregnate the distribution element with finish oil which can then be released to the spinneret exit face over a specific period of time. This is especially advantageous where spinning periods are relatively short.

The above-described device is used according to the invention for the production of filaments or fibers from conventional synthetic polymers by the melt-spinning process. It can be used in the production of fibers of polyamides, polyesters, polyolefins and other suitable linear polymers. It is possible, in keeping with the invention, to spin fine denier yarns comprising few individual filaments of very low denier as well as heavy denier yarns comprising a plurality of individual filaments. Spinnerets for the spinning of tow of several 1000 dtex can be treated without difficulty.

It was indeed surprising that it is possible according to the invention to insure a uniform and continuous distribution of the finish on the exit face of the spinneret. Both small and large dimension spinnerets can be unobjectionally finished. The spinnerets can be supplied with finish over a longer period of time.

Hence, with spinnerets according to the invention, spinning times can be significantly increased without encountering problems due to dripping or deposits at the exit face of the spinneret.

The device of the invention can be installed easily on conventional spinnerets without extensive design modifications. Its design is very simple; cleansing after use can be accomplished quickly and without problems. The spinneret proper is not affected.

The distribution element can be produced at little cost, insuring a very economical process in the manufacture of filaments by the melt-spinning process. As the number of spinning malfunctions can be reduced, large packages holding yarn free from knots can be wound thus improving the quality of the yarn.

It will be understood that in the embodiments of the invention shown in FIGS. 1 and 3, the distribution element has interconnected channel-like recesses formed in a foil or sheet-like body and that these recesses and the exit face of the spinneret, i.e. the discharge surface of the spinning plate 6 or 13, together form channels through which the liquid finish flows. The portions of the exit face not covered by the distribution element are also wet by the liquid finish that flows out of the channels so that the portions of the exit face surrounding the spinning orifices are covered with the finish. The raised portions provided between the channel-like recesses may contact the exit face or may be spaced closely subjacent thereto.

In the embodiment of the invention shown in FIG. 2, wherein a screen type of distribution element 4 is utilized, the intestices between the wires provide channels in the space defined between the exit face of the spinneret and the upper face of the support plate 16. Here the support plate not only supports the distribution element, but also provides a support for the liquid finish.

It will also be appreciated that in all embodiments the extruded polymeric filaments passing through the film or layer of liquid finish on the exit face tend to remove the finish from the exit face so that the supply of finish to the distributionelement is continuously metered to insure the presence of the finish.

What is claimed is:

1. In combination, a spinneret having an exit face provided with a plurality of spinning orifices arranged in a pattern, through which polymeric filaments are melt extruded, and a device for effecting continuous application of a liquid finish to the exit face of the spinneret from which the filaments are extruded, said device including a removable and reinstallable distribution element having at least one opening corresponding to the pattern of the spinning orifices and means for directing the liquid finish around said at least one opening in said distribution element and for distributing the liquid finish onto said exit face, and fastening means for fitting the distribution element subjacent to the exit face of the spinneret, said fastening means having an opening to supply the finish to the distribution element.

2. The combination according to claim 1, wherein said distribution element is in the form of a flat metal screen.

3. The combination according to claim 1, wherein the distribution element comprises a flat perforated metal foil.

4. The combination according to claim 1, wherein the distribution element comprises a metal foil provided with mutually connected channel-like recesses and an inlet for the liquid finish.

5. The combination according to claim 4, wherein the foil has a pattern of raised portions that serve as baffles between individual channel-like recesses.

6. The combination according to one of claims 1 to 5, wherein the distribution element has an annular shape.

7. The combination according to one of claims 1 to 5, wherein the distribution element is in the form of a plate that extends over the exit face of said spinneret.

8. The combination according to claim 7, wherein said distribution element has a plurality of slit-like openings that allow passage of the extruded filaments.

9. The combination according to claim 1, wherein the distribution element is formed of a surface active material with respect to said finish.

10. The combination according to claim 1, wherein the fastening means comprises a supporting surface portion of a spinneret housing in which said spinneret is positioned with said distribution element.

11. The combination according to claim 2 or 3, wherein the fastening means is a support plate having at least one slit-shaped opening provided therein.

12. The combination according to claim 1, wherein said spinneret further including a housing provided at a lower end thereof with a support means and a spinning plate having said plurality of spinning orifices positioned within said housing, said distribution element being arranged subjacent to the spinning plate and being supported by said support means.

13. The combination according to claim 1, further comprising means for metering said liquid finish to said distribution element via the opening in said fastening means.

14. A device for providing a liquid finish on the exit face of a spinneret for the melt spinning of polymeric materials through at least one spinning orifice, which comprises a distribution element having at least one opening correponding to a pattern of the at least one spinning orifice and means for directing liquid finish around said at least one opening and for distributing the liquid finish onto said exit face, and fastening means for positioning the distribution element closely subjacent to said exit face.

* * * * *